US010716372B1

(12) United States Patent
Li

(10) Patent No.: US 10,716,372 B1
(45) Date of Patent: Jul. 21, 2020

(54) UMBRELLA FRAME BENDING STRUCTURE FOR TWO-FOLD INVERTED UMBRELLA

(71) Applicant: Sheng-Chun Li, Taoyuan (TW)

(72) Inventor: Sheng-Chun Li, Taoyuan (TW)

( * ) Notice: Subject to any disclaimer, the term of this patent is extended or adjusted under 35 U.S.C. 154(b) by 0 days.

(21) Appl. No.: 16/245,109

(22) Filed: Jan. 10, 2019

(30) Foreign Application Priority Data

Nov. 7, 2018 (TW) ..... 107139494 A

(51) Int. Cl.
*A45B 25/02* (2006.01)
*A45B 19/00* (2006.01)
*A45B 25/22* (2006.01)

(52) U.S. Cl.
CPC ..... *A45B 25/02* (2013.01); *A45B 19/00* (2013.01); *A45B 25/22* (2013.01); *A45B 2019/008* (2013.01)

(58) Field of Classification Search
CPC ..... A45B 25/02; A45B 25/22; A45B 19/00; A45B 25/06; A45B 2019/008; A45B 2019/001
USPC ..... 135/25.3, 25.31, 25.32, 27–29, 31–32
See application file for complete search history.

(56) References Cited

U.S. PATENT DOCUMENTS 850,341 A * 4/1907 Callahan ..... A45B 25/22 135/27
1,045,976 A * 12/1912 Hildreth ..... A45B 19/10 135/25.3
4,030,515 A * 6/1977 Weber ..... A45B 19/00 135/25.3
6,186,157 B1 * 2/2001 Lin ..... A45B 25/22 135/25.1
6,276,380 B1 * 8/2001 Okuda ..... A45B 25/22 135/31
6,588,439 B2 * 7/2003 Wu ..... A45B 19/10 135/27
6,863,081 B2 * 3/2005 Hsieh ..... A45B 25/02 135/25.3
6,941,959 B2 * 9/2005 Kung-Tai ..... A45B 25/02 135/29
7,415,986 B2 * 8/2008 Wu ..... A45B 25/22 135/31
8,607,808 B1 * 12/2013 You ..... A45B 25/22 135/25.33
9,486,044 B1 * 11/2016 Dai ..... A45B 25/22
9,629,426 B1 * 4/2017 Dai ..... A45B 19/10

* cited by examiner

*Primary Examiner* — Winnie Yip

(57) ABSTRACT

An umbrella frame bending structure for two-fold inverted umbrella includes an umbrella shaft assembly, an umbrella frame and bending devices. The bending devices are arranged on the umbrella frame such that when the main ribs and auxiliary ribs of the umbrella frame are opened, the auxiliary ribs limit the opening distance of the main ribs, causing the main ribs to curve. The umbrella frame bending structure has the advantages of low cost, simple structure and ease of installation.

3 Claims, 5 Drawing Sheets

UMBRELLA FRAME BENDING STRUCTURE FOR TWO-FOLD INVERTED UMBRELLA

BACKGROUND OF THE INVENTION

1. Field of the Invention

The present invention relates to umbrella technology and more particularly, to an umbrella frame bending structure for two-fold inverted umbrella, which uses bending devices to limit the extending distance of the main ribs when the umbrella is opened, causing the main ribs to curve.

2. Description of the Related Art

In a conventional inverted umbrella, the main ribs of the umbrella frame are loaded with spring members. When the umbrella frame is opened, the spring members are compressed so that the elastic restoring forcer of the spring members forces the main ribs to curve. The loading of these spring members greatly increases the cost of the umbrella frame and complicates its installation. Further, the spring members will fail to work normally due to elastic fatigue after a long use.

SUMMARY OF THE INVENTION

The present invention has been accomplished under the circumstances in view. It is therefore the main object of the present invention to provide an umbrella frame bending structure for two-fold inverted umbrella having the advantages of low cost, simple structure and ease of installation, which has bending devices are arranged on the umbrella frame thereof such that when the main ribs and auxiliary ribs of the umbrella frame are opened, the auxiliary ribs limit the opening distance of the main ribs, causing the main ribs to curve.

To achieve this and other objects of the present invention, an umbrella frame bending structure for two-fold inverted umbrella comprises an umbrella shaft assembly, an umbrella frame and a plurality of bending devices. The umbrella shaft assembly comprises an umbrella shaft, a handle connected to one end of the umbrella shaft, and a runner sleeved onto the umbrella shaft and movable back and forth along the umbrella shaft from an opposite end of the umbrella shaft remote from the handle. The umbrella frame comprises a plurality of main ribs, a plurality of auxiliary ribs, and a plurality of stretchers. Each main rib comprises a first main rib segment and a second main rib segment pivotally connected together. The first main rib segment has a distal end thereof connected to the opposite end of the umbrella shaft remote from the handle. Each auxiliary rib has one end thereof connected to the runner. Each stretcher has one end thereof connected to the runner, and an opposite end thereof connected to the first main rib segment of one respective main rib. Each bending device comprises a stop block and a position-limiting member. The stop block is protruded from the second main rib segment of one respective main rib between two ends thereof so that the second main rib segment defines a sliding portion between the distal end thereof and the respective stop block. The position-limiting member comprises a channel slidably coupled to the sliding portion of the second main rib segment of one respective main rib, and an engagement portion protruded from an inside wall of the channel. The auxiliary rib has the distal end thereof connected to the position-limiting member of one respective bending device. When the umbrella frame is closed, the first main rib segments and second main rib segments of the main ribs are received together and disposed close to the umbrella shaft. When the umbrella frame is opened to move the runner along the umbrella shaft in direction away from the handle, the stretchers push the first main rib segments of the main ribs to cause extension of the respective second main rib segments in direction away from the umbrella shaft, and the stop blocks are forced to stop against the engagement portions of the respective position-limiting member to further keep the first main rib segments and the second main rib segments to position near a parallel state, thereafter the stretchers are forced to move the pivot connection areas between the first main rib segments and the second main rib segments, causing the first main rib segments and the second main rib segments to curve.

Other advantages and features of the present invention will be fully understood by reference to the following specification in conjunction with the accompanying drawings.

DETAILED DESCRIPTION OF THE PREFERRED EMBODIMENT

Figure 1:
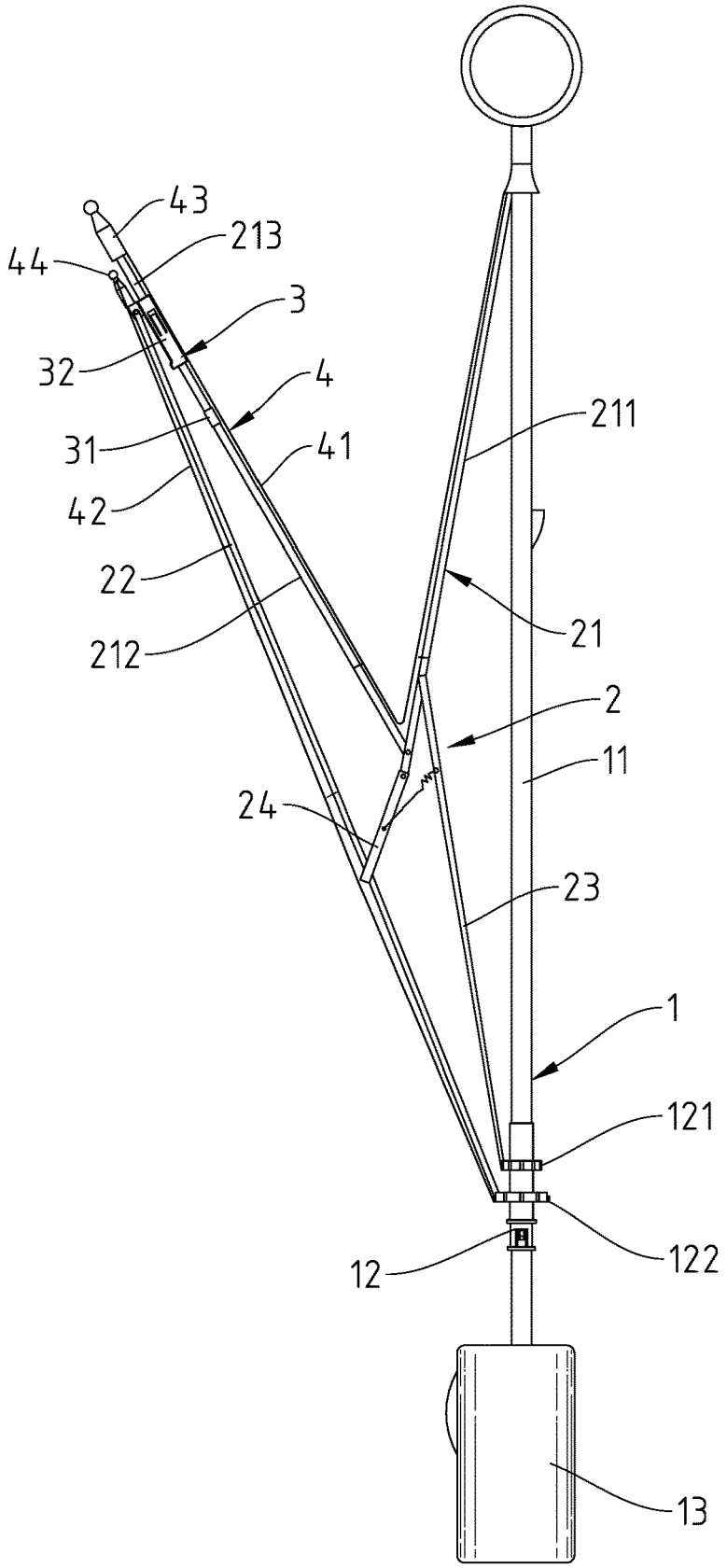
FIG. 1 is an elevational view of an umbrella frame bending structure for two-fold inverted umbrella in a received position in accordance with the present invention.
Figure 2:
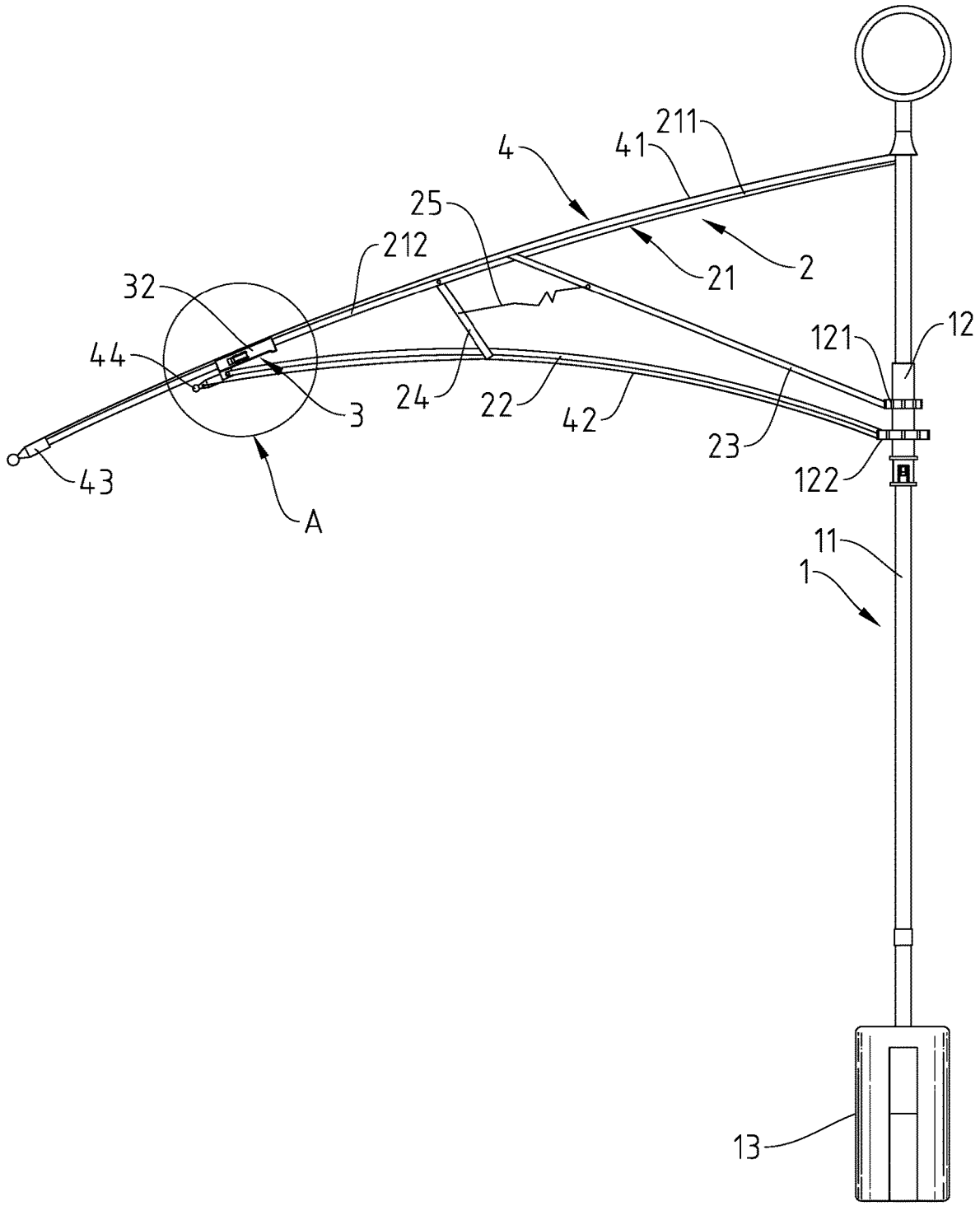
FIG. 2 is an elevational view of the umbrella frame bending structure for two-fold inverted umbrella in an opened position in accordance with the present invention.
Figure 3:
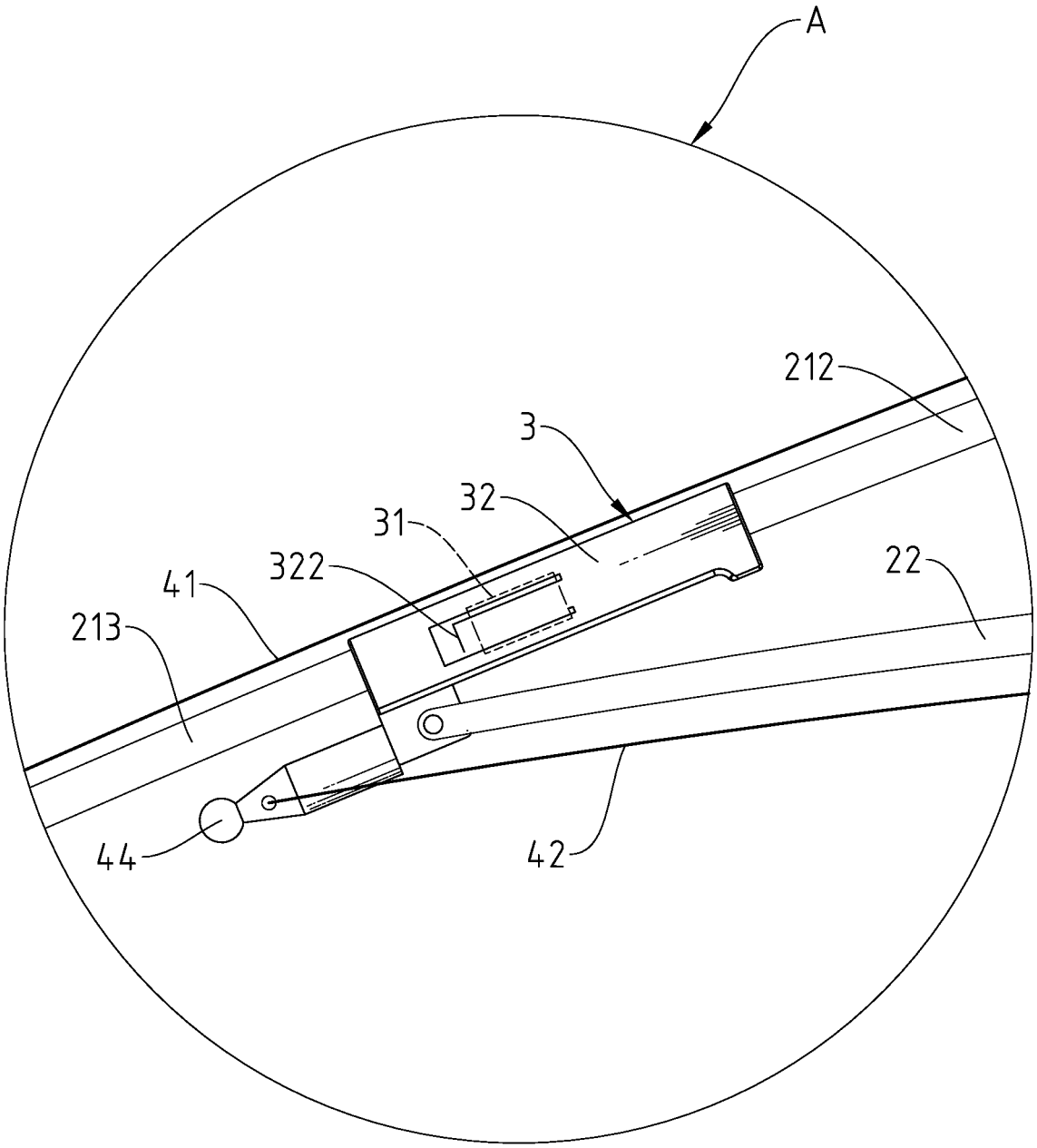
FIG. 3 is an enlarged view of Part A of FIG. 2.
Figure 4:
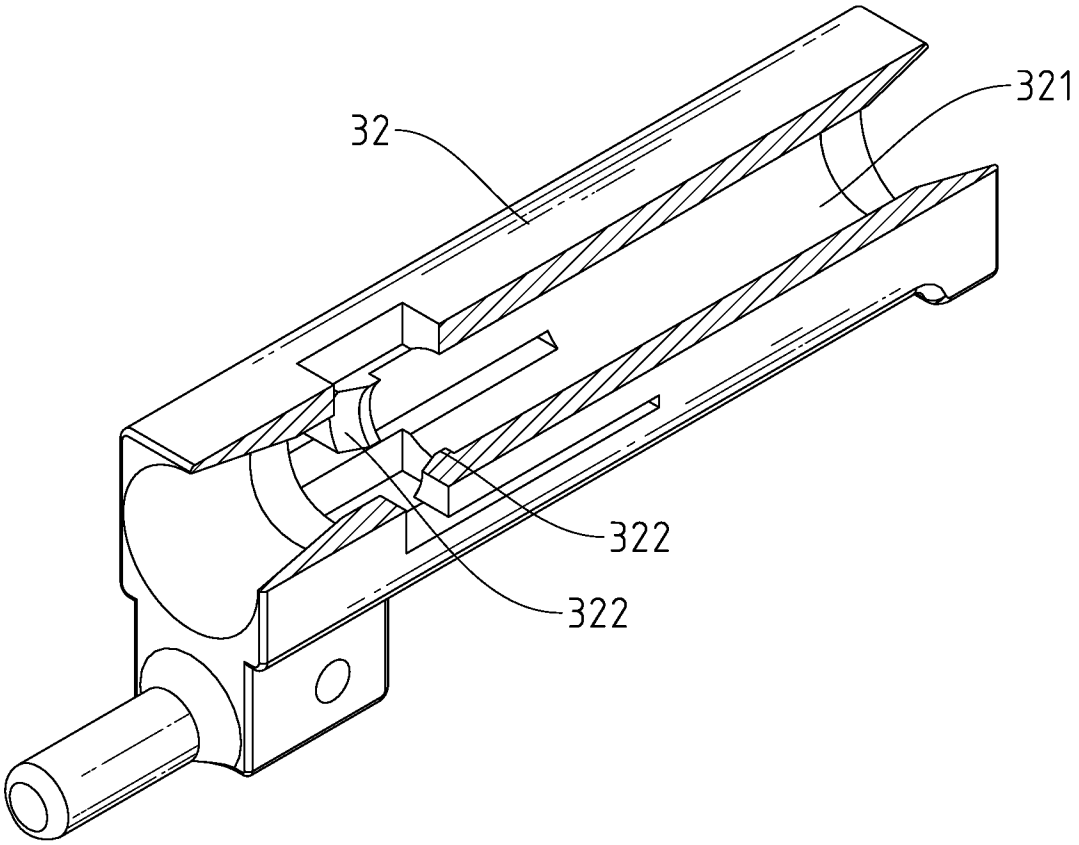
FIG. 4 is a sectional elevation of the position-limiting member.
Figure 5:
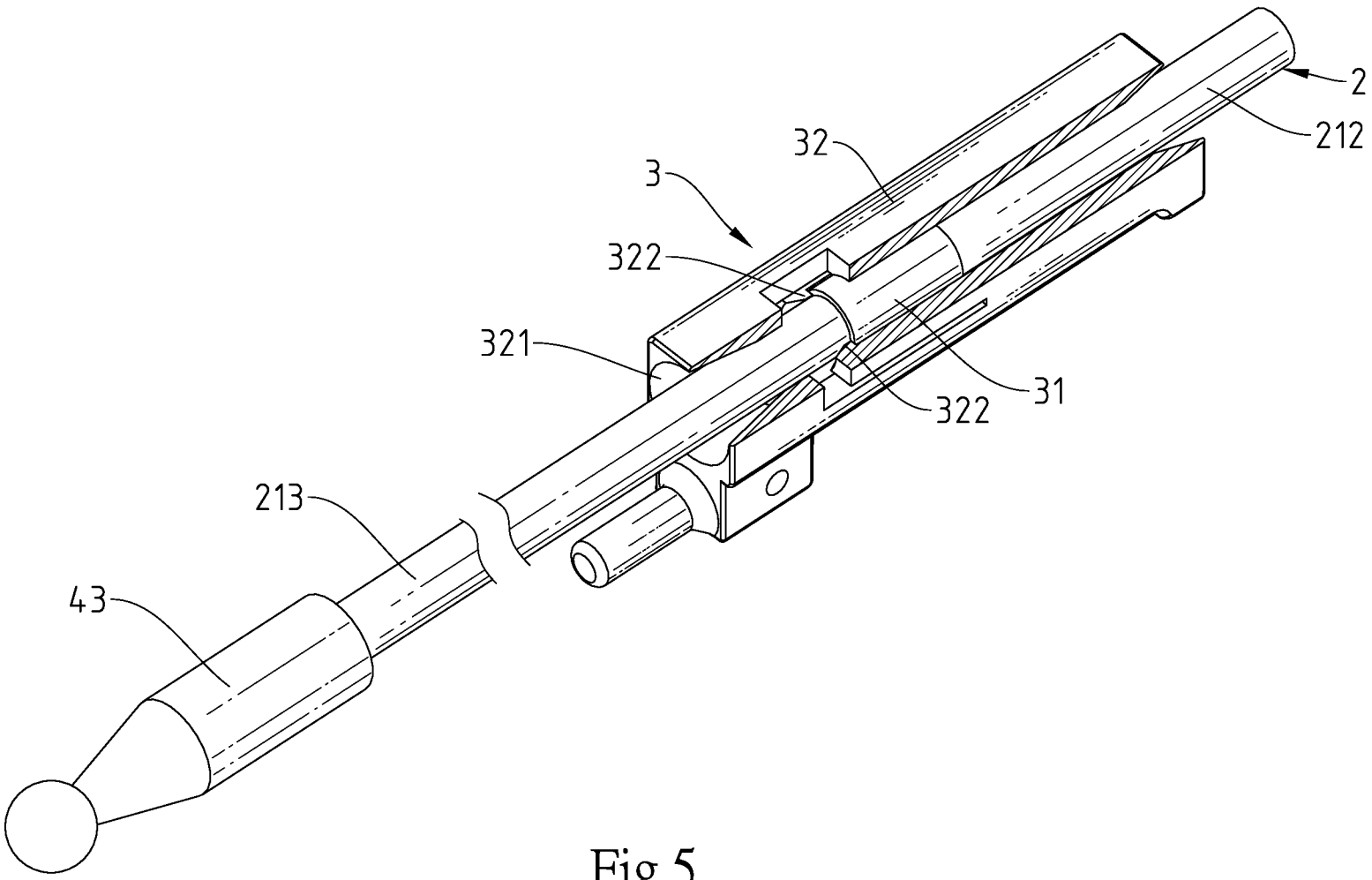
FIG. 5 is a sectional elevation of a part of the present invention, illustrating the bending device held in position.

Referring to FIGS. 1-5, an umbrella frame bending structure for two-fold inverted umbrella in accordance with the present invention is shown. The umbrella frame bending structure comprises an umbrella shaft assembly 1, an umbrella frame 2, a bending device 3 and a canopy 4.

The umbrella shaft assembly 1 comprises an umbrella shaft 11, a handle 13 connected to one end of the umbrella shaft 11, and a runner 12 is sleeved onto the umbrella shaft 11 and displaced back and forth away from the other side of the handle 13. The runner 12 comprises an upper nest 121 disposed at one side thereof remote from the handle 13, and a lower nest 122 disposed at an opposite side thereof.

The umbrella frame 2 comprises a plurality of main ribs 21, a plurality of auxiliary ribs 22, a plurality of stretchers 23, a plurality of connection rods 24 and a plurality of elastic members 25. Each main rib 21 comprises a first main rib segment 211 and a second main rib segment 212 pivotally connected together. The first main rib segment 211 has the distal end thereof connected to the umbrella shaft 11. Each auxiliary rib 22 has one end thereof pivotally connected to the lower nest 122 of the runner 12 of the umbrella shaft assembly 1. Each stretcher 23 has one end thereof connected to the runner 12, and an opposite end thereof connected to the first main rib segment 211 of one respective main rib 21. Each connection rod 24 has one end thereof connected between the first main rib segment 211 and second main rib segment 212 of one respective main rib 21, and an opposite end thereof conned between the two ends of one respective auxiliary rib 22. The elastic members 25 are respectively connected between the connection rods 24 and the stretchers 23.

The bending device 3 comprised a plurality of stop blocks 31 and a plurality of position-limiting members 32. Each stop block 31 protrudes from the second main rib segment 212 of one respective main rib 21 of the umbrella frame 2 between two ends thereof so that the second main rib segment 212 defines a sliding portion 213 between the stop block 31 and the distal end thereof. Each position-limiting member 32 comprises a channel 321, and an engagement portion 322 protruded from an inside wall of the channel 321. By means of the channel 321, the position-limiting member 32 is sleeved onto the sliding portion 213 of one respective main rib 21. The distal end of each auxiliary rib 22 is connected to one respective position-limiting member 32.

The canopy 4 comprises an outer canopy cloth 41 fastened to the main ribs 21 at a top side, a plurality of outer tips 43 equiangularly affixed to a border edge of the outer canopy cloth 41 for the connection of the distal ends of the second main rib segments 212 of the main ribs 21, an inner canopy cloth 42 fastened to the auxiliary ribs 22 at a bottom side, and a plurality of inner tips 44 equiangularly affixed to a border edge of the inner canopy cloth 42 for the connection of the distal ends of the auxiliary rib 22.

Please refer to FIGS. 1-5. As illustrated in FIG. 1, when the umbrella frame 2 is closed (collapsed), the first main rib segments 211 and the second main rib segments 212 are received to the umbrella shaft 11, and the elastic members 25 pull the connection rods 24 and the stretcher 23 together to hold the auxiliary ribs 22 close to the umbrella shaft 11. As illustrated in FIGS. 2-5, when the umbrella frame 2 is opened, the runner 12 is moved in direction away from the handle 13, causing the upper nest 121 and lower nest 122 of the runner 12 to move the auxiliary ribs 22 and the stretchers 23, thus, the stretchers 23 push the respective first main rib segments 211, causing the second main rib segments 212 to extend in direction away from the umbrella shaft 11. At this time, the stop blocks 31 are stopped at the engagement portions 322 of the associating position-limiting members 32 to hold the first main rib segments 211 and the second main rib segments 212 approximately in a parallel manner. Thereafter, the stretchers 23 keep pushing the pivot joints between the first main rib segments 211 and the second main rib segments 212, causing the first main rib segments 211 and the second main rib segments 212 to pass over the parallel state into a curved state. Because the first main rib segments 211 and the second main rib segments 212 are constrained by the respective bending devices 3, they cannot be fully extended out, thus, the stretchers 23 keep pushing the pivot joints between the first main rib segments 211 and the second main rib segments 212 to displace, the first main rib segments 211 and the second main rib segments 212 directly move over the parallel state into the curved state. Further, when the umbrella frame 2 is opened, and the first main rib segments 211 and the second main rib segments 212 are curved, the main ribs 21 drive the connection rods 24 to curve the auxiliary ribs 22.

What the invention claimed is:

1. A umbrella frame bending structure for two-fold inverted umbrella, comprising an umbrella shaft assembly, an umbrella frame and a plurality of bending devices, said umbrella shaft assembly comprising an umbrella shaft, a handle connected to one end of said umbrella shaft and a runner sleeved onto said umbrella shaft and movable back and forth along said umbrella shaft from an opposite end of said umbrella shaft remote from said handle, said umbrella frame comprising a plurality of main ribs, a plurality of auxiliary ribs and a plurality of stretchers, each said main rib comprising a first main rib segment and a second main rib segment pivotally connected together, said first main rib segment having a distal end thereof connected to the opposite end of said umbrella shaft remote from said handle, each said auxiliary rib having one end thereof connected to said runner, each said stretcher having one end thereof connected to said runner and an opposite end thereof connected to the said first main rib segment of one respective said main rib;

wherein each said bending device comprises a stop block and a position-limiting member, said stop block being protruded from the said second main rib segment of one respective said main rib between two ends thereof so that said second main rib segment defines a sliding portion between the distal end thereof and the respective said stop block, said position-limiting member comprising a channel slidably coupled to said sliding portion of the said second main rib segment of one respective said main rib and an engagement portion protruded from an inside wall of said channel; said auxiliary rib has the distal end thereof connected to said position-limiting member of one respective said bending device; when said umbrella frame is closed, said first main rib segments and said second main rib segments of said main ribs are received together and disposed close to said umbrella shaft; when said umbrella frame is opened to move said runner along said umbrella shaft in direction away from said handle, said stretchers push said first main rib segments of said main ribs to cause extension of the respective said second main rib segments in direction away from said umbrella shaft, and said stop blocks are forced to stop against said engagement portions of the respective said position-limiting member to further keep said first main rib segments and said second main rib segments to position near a parallel state, thereafter said stretchers are forced to move the pivot connection areas between said first main rib segments and said second main rib segments, causing said first main rib segments and said second main rib segments to curve.

2. The umbrella frame bending structure for two-fold inverted umbrella as claimed in claim 1, wherein said runner of said umbrella shaft assembly comprises an upper nest disposed at one side thereof remote from said handle and a lower nest disposed at an opposite side thereof; the end of each said stretcher connected to said runner is pivotally connected to said upper nest, the end of each said auxiliary rib connected to said runner is pivotally connected to said lower nest; said upper nest and said lower nest are forced to move said auxiliary ribs and said stretcher when said runner is moved along said umbrella shaft.

3. The umbrella frame bending structure for two-fold inverted umbrella as claimed in claim 1, wherein said umbrella frame further comprises a plurality of connection rods and a plurality of elastic members, each said connection rod having one end thereof pivotally connected between said first main rib segment and said second main rib segment and an opposite end thereof connected between the two ends of one respective said auxiliary rib, said elastic members being respectively connected between said connection rods and said stretchers and adapted to pull said connection rods toward the respective said stretcher so that when said umbrella frame is opened and said first main rib segments and said second main rib segments are curbed, said main ribs drive said connection rods to curve said auxiliary ribs.

* * * * *